US012698629B2

(12) United States Patent
Pilz et al.

(10) Patent No.: US 12,698,629 B2
(45) Date of Patent: Aug. 4, 2026

(54) WINDOW MULLION TO INTERIOR WALL TRANSITION ASSEMBLY

(71) Applicant: CEMCO, LLC, City of Industry, CA (US)

(72) Inventors: Donald Anthony Pilz, Livermore, CA (US); David Mistler, City of Industry, CA (US)

(73) Assignee: CEMCO, LLC, City of Industry, CA (US)

( * ) Notice: Subject to any disclaimer, the term of this patent is extended or adjusted under 35 U.S.C. 154(b) by 127 days.

(21) Appl. No.: 18/792,321

(22) Filed: Aug. 1, 2024

(65) Prior Publication Data

US 2025/0043568 A1 Feb. 6, 2025

Related U.S. Application Data

(60) Provisional application No. 63/517,055, filed on Aug. 1, 2023.

(51) Int. Cl.
*E04B 1/94* (2006.01)

(52) U.S. Cl.
CPC ..... *E04B 1/948* (2013.01)

(58) Field of Classification Search
CPC ..... E04B 1/948; E04B 1/6815; E04B 2/82; E04B 2/90; E04B 2/96; E04B 2/7409; E04B 2/7411
See application file for complete search history.

(56) References Cited

U.S. PATENT DOCUMENTS

| | | | | |
|---|---|---|---|---|
| 5,452,551 | A | 9/1995 | Charland | |
| 5,681,640 | A | 10/1997 | Kiser | |
| 6,351,915 | B1 * | 3/2002 | Puckett | E04B 2/96 52/235 |
| 8,444,790 | B2 | 5/2013 | Tong | |
| 10,166,418 | B2 | 1/2019 | Foerg | |
| 10,220,226 | B2 | 3/2019 | Foerg | |
| 11,873,636 | B2 * | 1/2024 | Pilz | E04B 1/948 |
| 12,024,881 | B1 * | 7/2024 | Laydera-Collins | E04B 1/82 |
| 2006/0137293 | A1 * | 6/2006 | Klein | E04B 2/7411 52/782.1 |

(Continued)

FOREIGN PATENT DOCUMENTS

| | | |
|---|---|---|
| CN | 220201817 | 12/2023 |
| WO | 2015121278 | 8/2015 |

*Primary Examiner* — Christine T Cajilig
(74) *Attorney, Agent, or Firm* — VIA LLP

(57) ABSTRACT

A fire-rated wall assembly includes a first wall and a second wall. The first wall can be an exterior curtain wall including a window mullion and a glass panel extending away from the window mullion. The second wall can be an interior stud wall including a stud positioned adjacent to the window mullion. A wallboard is coupled to the stud and has a cantilevered portion between the stud and the glass panel. The wallboard has an end surface facing and spaced from the glass panel to create a gap therebetween. A wallboard support is coupled to the stud and extends toward the glass panel. The wallboard support is positioned between the stud and the cantilevered portion of the wallboard. An elongated fire-rated component is coupled to the wallboard. At least a portion of the elongated fire-rated component is positioned within the gap.

19 Claims, 4 Drawing Sheets

(56) References Cited

U.S. PATENT DOCUMENTS

| | | | | |
|---|---|---|---|---|
| 2012/0180414 | A1* | 7/2012 | Burgess | E04B 2/90 52/300 |
| 2020/0080300 | A1* | 3/2020 | Pilz | E04B 2/7409 |
| 2020/0240140 | A1* | 7/2020 | Pilz | E04B 2/7457 |

* cited by examiner

WINDOW MULLION TO INTERIOR WALL TRANSITION ASSEMBLY

INCORPORATION BY REFERENCE

This application claims priority to U.S. Provisional Application No. 63/517,055, filed Aug. 1, 2023, entitled WINDOW MULLION TO INTERIOR WALL TRANSITION ASSEMBLY, the entirety of which is hereby incorporated by reference herein.

BACKGROUND

Field

The present disclosure relates to building assemblies. In particular, the present disclosure relates to fire and/or sound-rated joints between portions of a building assembly.

Description of the Related Art

Fire-rated and/or sound-rated construction components and assemblies are commonly used in the construction industry. These components and assemblies are aimed at inhibiting or preventing fire, heat, smoke, or sound from leaving one room or other portion of a building and entering another room or portion of a building. The fire, heat, smoke, or sound usually moves between rooms through vents, joints in walls, or other openings. The fire-rated components often incorporate fire-retardant materials which substantially block the path of the fire, heat, or smoke for at least some period of time. Intumescent materials work well for this purpose because they swell and char when exposed to flames helping to create a barrier to the fire, heat, and/or smoke.

Some particular wall joints with a high potential for allowing fire, heat, or smoke to pass from one room to another is the joint between a wall and an adjacent structure, which can be a ceiling, a floor, or another wall. A joint between the top of a wall and the ceiling can be referred to as a head-of-wall joint. A joint between the bottom of a wall and the floor can be referred to as a foot-of-wall joint. A joint between the side of a wall and another structure can be referred to as a side-of-wall joint. In modern multi-story or multi-level buildings, the head-of-wall joint and/or the side-of-wall joint is often a dynamic joint in which relative movement between the ceiling and the wall or between the two walls is permitted. This relative movement is configured to accommodate deflection in the building due to loading of the building or seismic forces. A wall assembly commonly includes a header track, bottom track, a plurality of wall studs and a plurality of wall board members, possibly among other components. A typical header track resembles a generally U-shaped (or some other similarly shaped) elongated channel capable of receiving or covering the ends of wall studs and holding the wall studs in place. The header track also permits the wall assembly to be coupled to an upper horizontal support structure, such as a ceiling or floor of a higher-level floor of a multi-level building.

Header tracks generally have a web and a pair of flanges, which extend in the same direction from opposing edges of the web. The header track can be a slotted header track, which includes a plurality of slots spaced along the length of the track and extending in a vertical direction. When the wall studs are placed into the slotted track, each of the plurality of slots aligned with a wall stud accommodates a fastener used to connect the wall stud to the slotted track. The slots allow the wall studs to move generally orthogonally relative to the track, creating a variable deflection gap between the wall board and the upper horizontal support structure. In those areas of the world where earthquakes are common, movement of the wall studs is important. If the wall studs are rigidly attached to the slotted track and not allowed to move freely in at least one direction, the stability of the wall and the building might be compromised. With the plurality of slots, the wall studs are free to move. Even in locations in which earthquakes are not common, movement between the studs and the header track can be desirable to accommodate movement of the building structure due to other loads, such as stationary or moving overhead loads.

The conventional method for creating a fire-rated joint between a wall and another structure is to stuff a fire-resistant mineral wool material into the joint and then spray an elastomeric material over the joint to retain the mineral wool in place, which can be referred to as a "stuff-and-spray" approach. This conventional construction of a fire-rated wall joint is time-consuming, expensive and has other disadvantages. More recently, specialized components have been created that create a fire-rated joint without the time-consuming stuff-and-spray approach. However, a need still exists for cost-effective fire or sound-rated joints in applications that are not well-served by the existing systems.

SUMMARY

The systems, methods and devices described herein have innovative aspects, no single one of which is indispensable or solely responsible for their desirable attributes. Without limiting the scope of the claims, some of the advantageous features will now be summarized.

One application that can be improved over the existing systems is the joint between an exterior curtain wall and an interior partition wall. However, the arrangements disclosed herein can also be useful for other similar construction joints, as will be appreciated by those skilled in the art.

An aspect of the present disclosure involves a fire-rated wall assembly including a window mullion, a glass panel extending away from the window mullion, and a stud wall. The stud wall includes a stud positioned adjacent to the window mullion. At least one wallboard is coupled to the stud and has a cantilevered portion between the stud and the glass panel. The at least one wallboard has an end surface facing the glass panel. The end surface spaced from the glass panel to create a gap therebetween. A wallboard support is coupled to the stud and extends toward the glass panel. The wallboard support is positioned between the stud and the cantilevered portion of the at least one wallboard. An elongated fire-rated component is coupled to the at least one wallboard. At least a portion of the elongated fire-rated component is positioned within the gap.

In some configurations, the wallboard support includes an abutment portion configured to contact the end surface of the at least one wallboard.

In some configurations, the abutment portion is positioned in the gap.

In some configurations, the abutment portion is spaced from the glass panel.

In some configurations, the wallboard support includes a first leg and a second leg.

In some configurations, the wallboard support is a metal L-shaped angle piece, and the first leg is coupled to the stud and the second leg defines the abutment portion.

In some configurations, the stud is spaced from an end surface of the window mullion.

In some configurations, the elongated fire-rated component comprises a profile having an L-shape in cross-section. The profile includes a first leg and a second leg. The first leg is positioned along an outward-facing surface of the wallboard and the second leg is positioned along the end surface of the at least one wallboard. The component further comprises a fire-blocking material strip attached to the profile.

In some configurations, the elongated fire-rated component includes a compressible gasket that contacts the glass panel.

In some configurations, the compressible gasket is a hollow gasket.

In some configurations, at least one wallboard comprises a first layer and a second layer that overlaps the first layer.

In some configurations, the wallboard support includes an abutment portion configured to contact the end surface of the at least one wallboard. The abutment portion is in contact with the first layer. The elongated fire-rated component is in contact with the second layer.

In some configurations, the at least one wallboard is spaced from an adjacent side surface of the window mullion.

In some configurations, the wallboard support has a length of at least 4 inches in a direction between the stud and the glass panel.

In some configurations, the wallboard support has a length of at least 6 inches in a direction between the stud and the glass panel.

In some configurations, the wallboard support has a length of between 4 and 8 inches in a direction between the stud and the glass panel.

In some configurations, the wallboard support has a length of between 6 and 8 inches in a direction between the stud and the glass panel.

An aspect of the present disclosure involves a fire-rated building assembly including a first wall and a second wall oriented at an angle relative to the first wall. The second wall includes a plurality of studs that includes an end stud. At least one wallboard is coupled to the plurality of studs and the end stud and has a cantilevered portion that extends beyond the end stud in a first direction away from a remainder of the plurality of studs. The at least one wallboard has an end surface facing the first wall. The end surface is spaced from the first wall to create a gap therebetween. A wallboard support is coupled to the end stud and extends in the first direction. The wallboard support is positioned between the stud and the cantilevered portion of the at least one wallboard. An elongated fire-rated component is coupled to the at least one wallboard. The elongated fire-rated component includes a profile having a first leg and a second leg defining an L-shape in cross-section. The first leg is positioned along an outward-facing surface of the wallboard and the second leg is positioned along the end surface of the at least one wallboard. The component further comprises a fire-blocking material strip attached to the profile. At least a portion of the elongated fire-rated component is positioned within the gap.

In some configurations, the wallboard support includes an abutment portion configured to contact the end surface of the at least one wallboard.

In some configurations, the wallboard support is a metal L-shaped angle piece having a first leg and a second leg. The first leg is coupled to the stud and the second leg defines the abutment portion.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1:
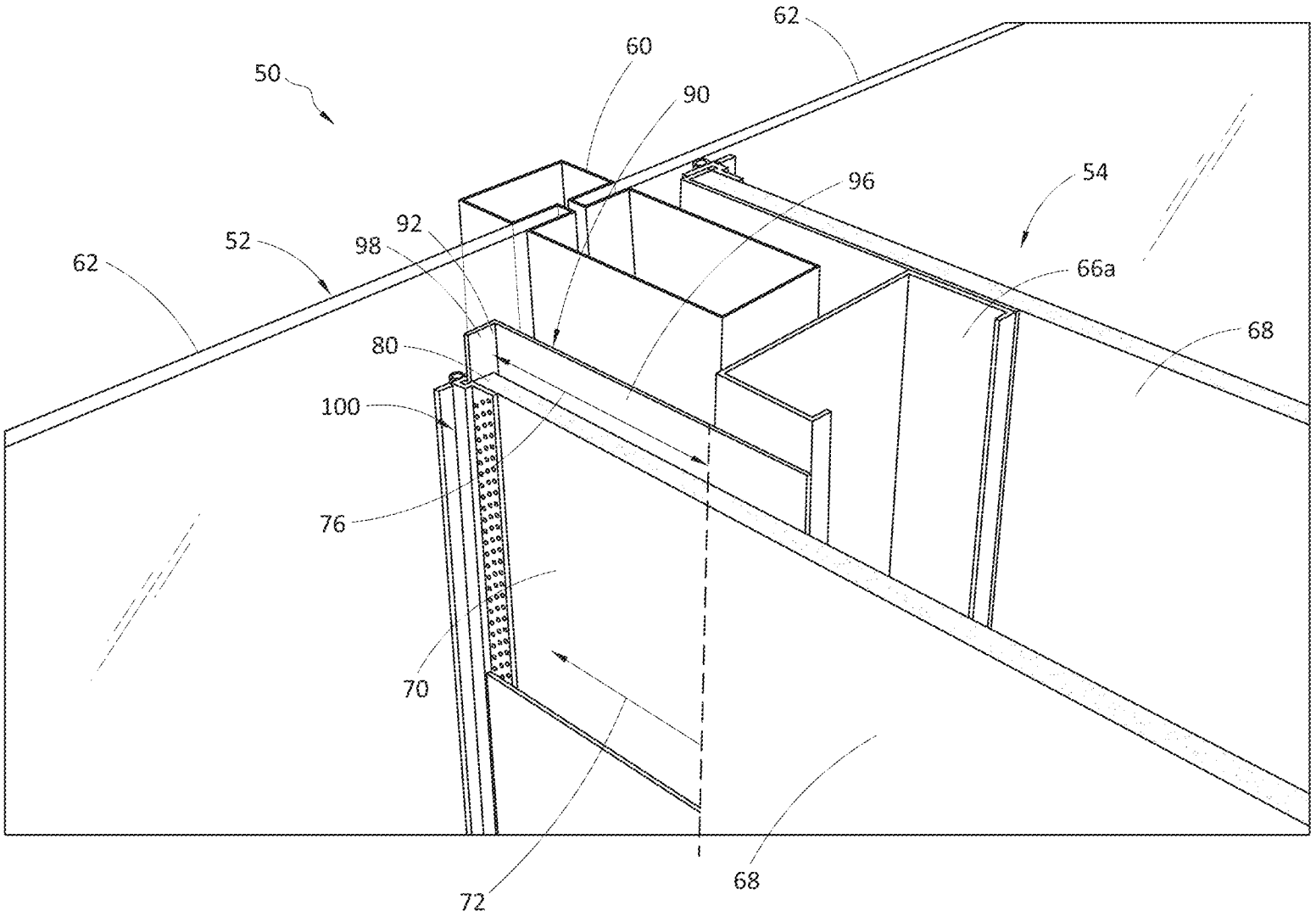
FIG. 1 is a perspective view of a construction joint between an exterior glass curtain wall and an interior partition stud wall.

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

Figure 2:
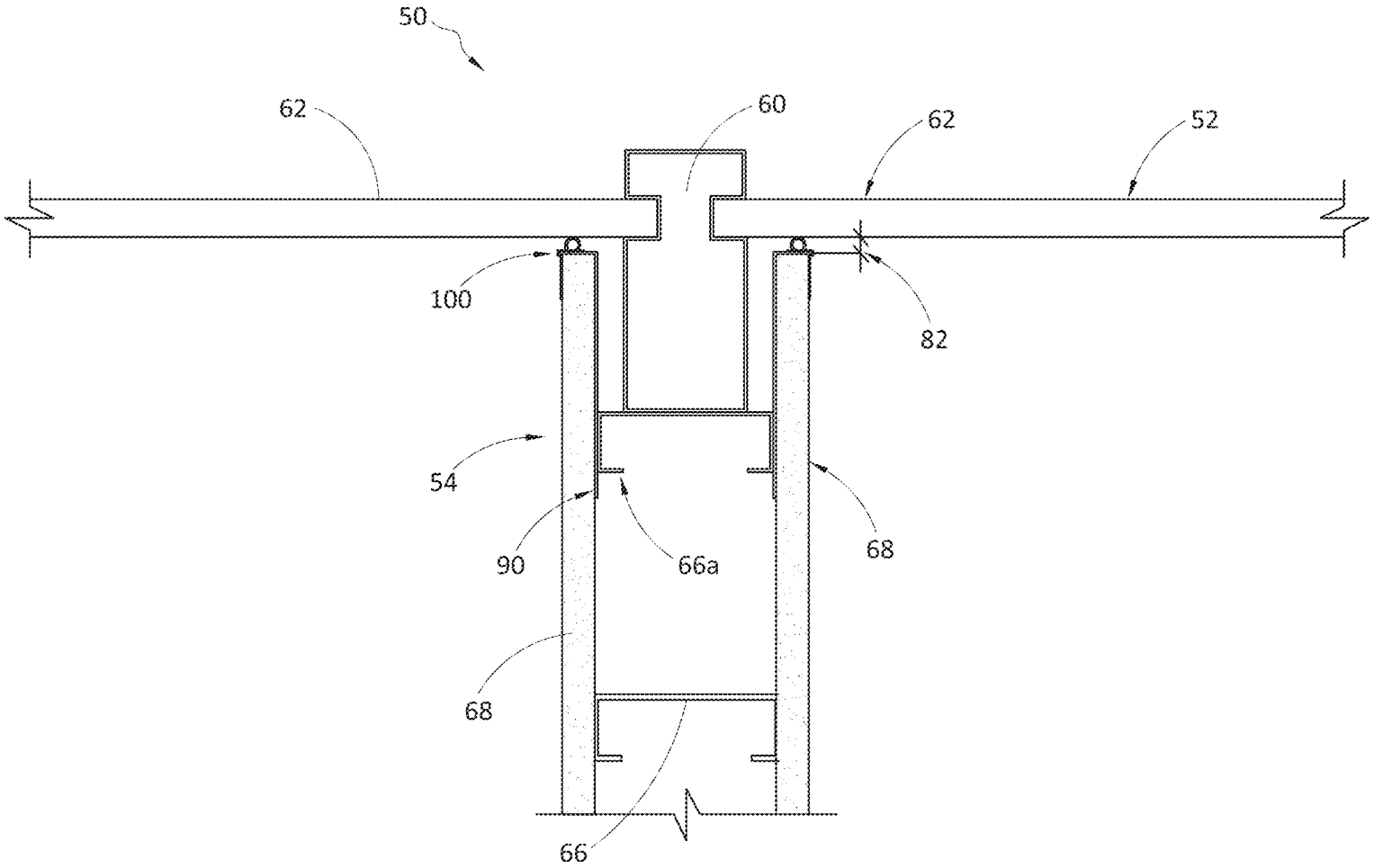
FIG. 2 is a plan view of the construction joint of FIG. 1.

FIGS. 1 and 2 illustrate a fire-rated building assembly 50 including a first wall 52 and a second wall 54. In the illustrated arrangement, the second wall 54 is oriented at an angle relative to the first wall 52. However, in other arrangements, the second wall 54 could be aligned with and abut the first wall 52 in an end-to-end arrangement. In the illustrated arrangement, the first wall 52 is an exterior wall, such as an exterior glass curtain wall. However, in other arrangements, the first wall 52 could be another type of wall, interior or exterior. The illustrated second wall 54 is an interior stud wall. However, in other arrangements, the second wall 54 could be another type of wall, interior or exterior.

The first wall 52 includes at least one window mullion 60. Typically, the first wall 52 includes a plurality of window mullions 60 that are spaced apart from one another along an exterior side or perimeter of a building. The first wall 52 also includes at least one glass panel 62. Typically, and in the illustrated arrangement, the first wall 52 includes a plurality of glass panels 62. Each pair of glass panels 62 is separated by one of the window mullions 60. Each glass panel 62 extends away from the window mullion 60. The window mullion 60 may have a pair of recesses that receive portions of the glass panels 62.

In some configurations, the second wall 54 is a stud wall, which includes a bottom or footer track coupled to a floor, a top or header track coupled to a ceiling or other overhead structure, and a plurality of studs 66 that extend between the bottom track and the header track. The plurality of studs 66 includes an end stud 66*a*. The end stud 66*a* is the closest to the window mullion 60 of the plurality of studs 66.

The second wall 54 includes a wall covering on each side of the second wall 54 in the form of at least one wallboard 68, such as drywall or gypsum board. Typically, a plurality of wallboards 68 are arranged to create a continuous covering on each side of the second wall 54. Seams between the individual pieces of wallboard 68 are covered by tape and joint compound, as is known in the art. The wallboards 68 are coupled to the plurality of studs 66. Lower wallboards 68 can also be coupled to the footer track. Upper wallboards 68 can be coupled to the header track. However, in some configurations, the upper wallboards 68 are not coupled to the header track and are spaced from the ceiling to create a deflection gap between an upper end of the wallboard 68 and the ceiling. In such an arrangement, often referred to as a dynamic head of wall joint, the upper ends of the studs 66 also are not coupled to the header track. As a result, the ceiling and header track can move relative to the studs 66, the wallboard 68, and the footer track to accommodate overhead, seismic, or other types of loads tending to deflect the ceiling.

For convenience, only one side of the second wall 54 is described in detail herein. The other side of the second wall 54 can be the same or substantially the same. In some configurations, however, the other side of the second wall 54 can be of another configuration. The wallboard 68 that is coupled to the end stud 66*a* has a cantilevered portion 70 that extends beyond the end stud 66*a* in a first direction 72 away from a remainder of the plurality of studs 66. The cantilevered portion 70 of the wallboard 68 is unsupported by the beyond the end stud 66*a* in the first direction 72. The cantilevered portion 70 of the wallboard 68 can have a dimension 76 in the first direction 72 of up to twelve inches (12") or more. However, in many configurations, the dimension in the first direction 72 is between 6-8 inches or less.

The cantilevered portion 70 is an end portion of the wallboard 68, which defines an end surface 80. The end surface 80 is spaced from the first wall 52 to create a gap 82 (FIG. 2) therebetween. In the illustrated arrangement, the wallboard 68 is aligned with, and the end surface 80 faces, the glass panel 62 of the first wall 52. Thus, the gap 82 is defined between the glass panel 62 and the end surface 80 of the wallboard 68.

The second wall 54 includes a wallboard support 90 that provides support to the cantilevered portion 70 of the wallboard 68. The wallboard support 90 is coupled to the end stud 66*a* and extends in the first direction 72 from the end stud 66*a*. The wallboard support 90 is positioned between the end stud 66*a* and the cantilevered portion 70 of the wallboard 68.

In the illustrated configuration, the wallboard support 90 includes an abutment portion 92 configured to directly or indirectly contact the end surface 80 of the wallboard 68. The abutment portion 92 can be positioned in the gap 82. In some configurations, the abutment portion 92 ensures that the gap 82 is present. Thus, the abutment portion 92 is spaced from the glass panel 62. The abutment portion 92 can be any structure suitable to contact and establish a location of the end surface 80 of the wallboard 68. In some configurations, the wallboard support 90 includes a first leg 96 and a second leg 98. The first leg 96 can be coupled to the end stud 66*a* and the second leg 98 can define the abutment portion 92. In some configurations, the wallboard support 90 is a metal L-shaped angle piece. However, in other configurations, the abutment portion 92 can be defined by a plurality of tabs or other similar structures. In some configurations, the abutment portion 92/second leg 98 can be omitted and the gap 82 can be established by a different method. For example, a spacer tool or spacer gauge could be used to create a properly sized gap 82 for either or both of the wallboard 68 and the wallboard support 90. In such a configuration, the wallboard support 90 could have a flat or planar shape that provides support to the cantilevered portion 70 of the wallboard 68. For example, the wallboard support 90 could be a flat metal sheet.

An elongated fire-rated component 100 is positioned within or along the gap 82. In the illustrated arrangement, the elongated fire-rated component 100 is coupled to the wallboard 68 and has a portion that is positioned within the gap 82 between the opposing front and rear surfaces of the wallboard 68. In some configurations, the elongated fire-rated component 100 is a fire-rated bead sold by Cemco Steel under the brand name SUPER SEAL-X. However, the elongated fire-rated component 100 could be any of the fire-rated beads disclosed in Applicant's U.S. Pat. No. 11,111,666, the entirety of which is incorporated by reference herein. In some configurations, if a fire-rating is not necessary or desired, the component 100 could be a sound-rated component that does not include a fire-resistant or intumescent material. Other elongated fire-rated components 100 that could be employed with the present assemblies can be those disclosed in Applicant's U.S. Pat. Nos. 10,689,842, 10,753,084, and U.S. Publication No. 2023/0203807, the entireties of which are incorporated by reference herein. Other components that could be employed as the component 100 in the present assemblies can be the fire or sound-rated components marketed by Cemco Steel under the brand names FIRE BEAD®, FIRE GASKET®, SOUND GASKET®, HOTROD® XL, HOTROD® Type-X, or SMOKE AND SOUND STOP.

Figure 5:
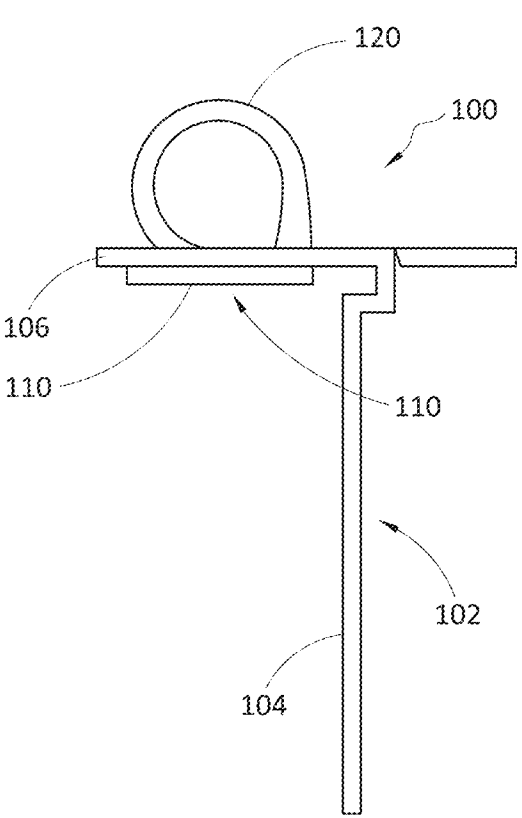
FIG. 5 is an end view of the fire-rated component of FIG. 4.
Figure 4:
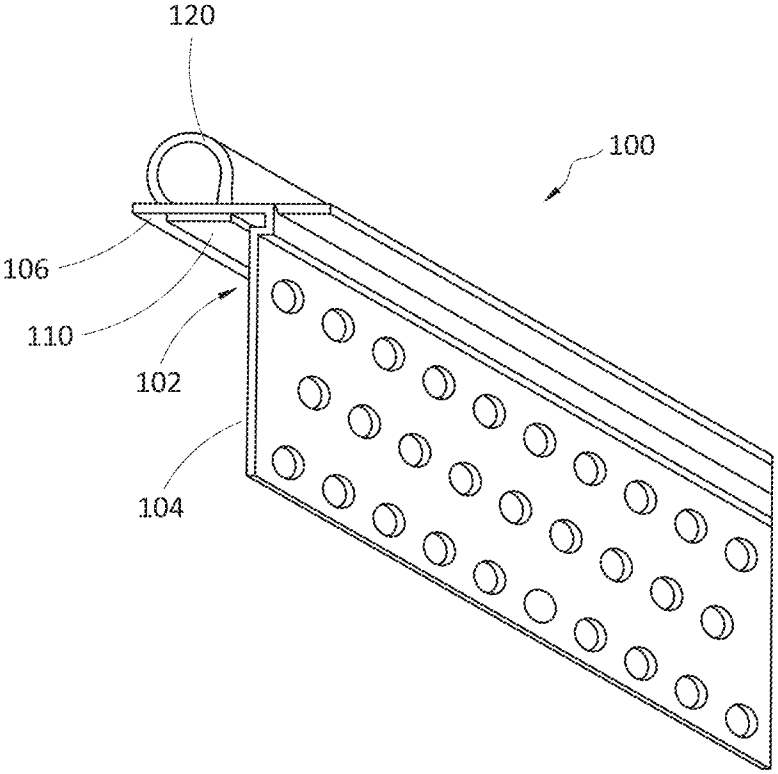
FIG. 4 is a perspective view of an example fire-rated component that can be employed in the construction joint of FIGS. 1-3.

As illustrated in FIGS. 4 and 5, the elongated fire-rated component 100 includes a profile 102 having a first leg 104 and a second leg 106 defining an L-shape in cross-section. The profile 102 can be an extruded plastic piece. In use, the first leg 104 is positioned along an outward-facing surface of the wallboard 68 and the second leg 106 is positioned along the end surface 80 of the wallboard 68. The second leg 106 can contact the abutment portion 92/second leg 98, if present, of the wallboard support 90. Otherwise, the second leg 106 can directly contact the end surface 80 of the wallboard 68.

The illustrated elongated fire-rated component 100 also includes a fire-blocking material strip 110 attached to the profile 102. The fire-blocking material strip 110 is positioned on the profile 102 such that the fire-blocking material strip 110 is positioned within the gap 82 when the elongated fire-rated component 100 is attached to the second wall 54.

In the illustrated arrangement, the fire-blocking material strip 110 is located on an interior surface of the profile 102 such that the fire-blocking material strip 110 faces or contacts the end surface 80 of the wallboard 68 or the second leg 98 of the wallboard support 90 in use. However, the fire-blocking material strip 110 could be placed on other locations of the profile 102. In some configurations, the fire-blocking material strip 110 contains an intumescent material or is an intumescent material strip such that the fire-blocking material strip 110 expands in response to a fire or heat above a threshold temperature to at least partially or completely seal the gap 82.

In some configurations, the elongated fire-rated component 100 includes a compressible gasket 120 that faces or contacts the glass panel 62 in use. The compressible gasket 120 is attached to the profile 102. In some configurations, the compressible gasket 120 is co-extruded with the profile 102. In some configurations, the compressible gasket 120 is a hollow gasket that defines an interior hollow space. However, the compressible gasket 120 can be of other configurations, including a solid, compressible configuration.

In some configurations, the end stud 66*a* is spaced from an adjacent end surface of the window mullion 60. In some configurations, the wallboard 68 is spaced from an adjacent side surface of the window mullion 60. In some configurations, the wallboard 68 is spaced from both the adjacent end surface and the adjacent side surface of the window mullion 60. Such arrangements permit relative movement between the first wall 52 and the second wall 54.

In some configurations, the wallboard support 90 has a length of at least 4 inches in the first direction 72. In some configurations, the wallboard support 90 has a length of at least 6 inches in the first direction 72. In some configurations, the wallboard support 90 has a length of between 4 and 8 inches in the first direction 72. In some configurations, the wallboard support 90 has a length of between 6 and 8 inches in the first direction 72. With such an arrangement, a single wallboard support 90 can be used in connection with several different sizes or types of window mullion 60 in which the dimension 76 of the cantilevered portion 70 of the wallboard 68 in the first direction 72 varies. To accommodate a particular window mullion 60 or a particular desired dimension 76 of the cantilevered portion 70, a position of the wallboard support 90 relative to the end stud 66*a* can be varied. Thus, any portion of the first leg 96 of the wallboard support 90 may be coupled to the end stud 66*a*.

Figure 3:
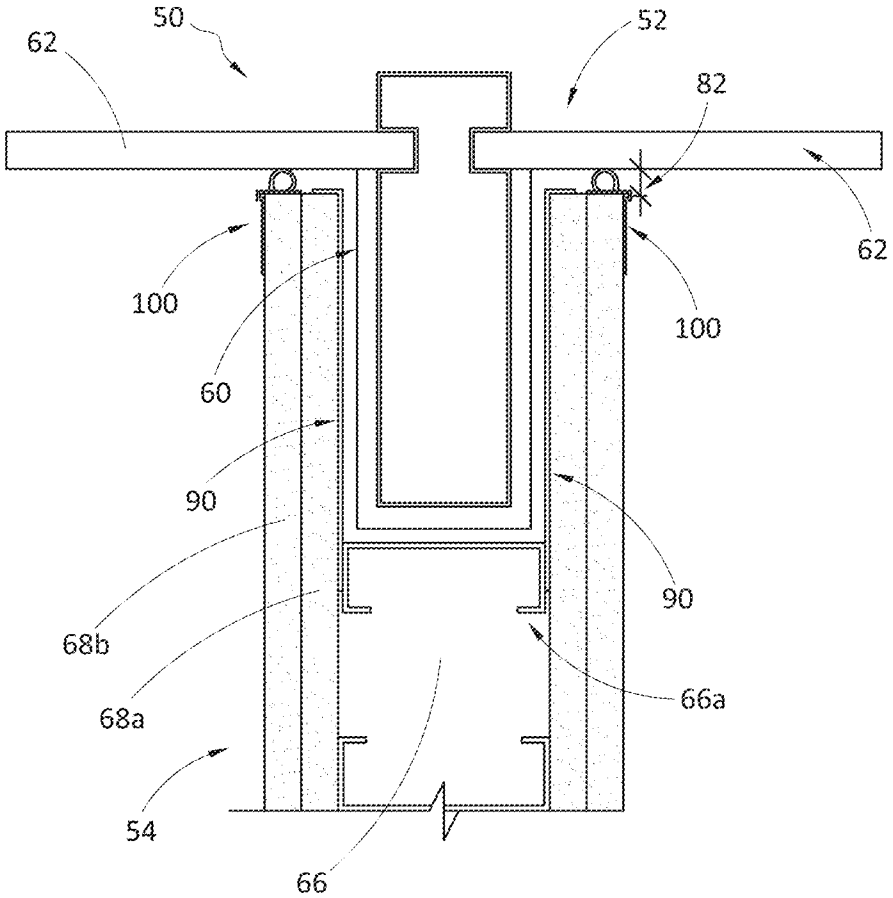
FIG. 3 is a plan view of an alternative construction joint in which the interior wall includes two layers of wallboard on each side of the wall.

FIGS. 1 and 2 illustrate the second wall 54 as having a single layer of wallboard 68. However, it some cases, additional layer(s) of wallboard 68 may be desired. FIG. 3 illustrates an assembly similar to that of FIGS. 1 and 2 but with two layers of wallboard 68 on each side of the second wall 54. That is, the wallboard 68 includes a first layer 68*a* and a second layer 68*b* that overlaps the first layer 68*a*. In such a configuration, the abutment portion 92/second leg 98 of the wallboard support 90 can contact the end surface 80 of the first layer 68*a* of the wallboard 68 and the elongated fire-rated component 100 can be in contact with the second layer 68*b* of the wallboard 68. In other respects, the arrangement of FIG. 3 can be the same as or similar to the arrangement of FIGS. 1 and 2.

Although the illustrated arrangement permits the accommodation of a window mullion 60, the arrangement could also permit the accommodation of other structures at the intersection of two walls. For example, the illustrated arrangement could permit the accommodation of vertical pipe(s), electrical conduit(s), air conduit(s), or other plumbing, electrical, HVAC, or other miscellaneous structures.

Conclusion

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A fire-rated wall assembly, comprising:
a window mullion;
a glass panel extending away from the window mullion;
a stud wall, comprising:
a stud positioned adjacent to the window mullion;
at least one wallboard coupled to the stud and having a cantilevered portion between the stud and the glass panel;
wherein the at least one wallboard has an end surface facing the glass panel, the end surface spaced from the glass panel to create a gap therebetween;
a wallboard support coupled to the stud and extending towards the glass panel, the wallboard support positioned between the stud and the cantilevered portion of the at least one wallboard;
an elongated fire-rated component coupled to the at least one wallboard, wherein at least a portion of the elongated fire-rated component is positioned within the gap.

2. The fire-rated wall assembly of claim 1, wherein the wallboard support includes an abutment portion configured to contact the end surface of the at least one wallboard.

3. The fire-rated wall assembly of claim 2, wherein the abutment portion is positioned in the gap.

4. The fire-rated wall assembly of claim 3, wherein the abutment portion is spaced from the glass panel.

5. The fire-rated wall assembly of claim 1, wherein the wallboard support includes a first leg and a second leg.

6. The fire-rated wall assembly of claim 5, wherein the wallboard support is a metal L-shaped angle piece, wherein the first leg is coupled to the stud and the second leg defines the abutment portion.

7. The fire-rated wall assembly of claim 1, wherein the stud is spaced from an end surface of the window mullion.

8. The fire-rated wall assembly of claim 1, wherein the elongated fire-rated component comprises a profile having an L-shape in cross-section, wherein the profile includes a first leg and a second leg, wherein the first leg is positioned along an outward-facing surface of the wallboard and the second leg is positioned along the end surface of the at least one wallboard, the component further comprises a fire-blocking material strip attached to the profile.

9. The fire-rated wall assembly of claim 8, wherein the elongated fire-rated component includes a compressible gasket that contacts the glass panel.

10. The fire-rated wall assembly of claim 9, wherein the compressible gasket is a hollow gasket.

11. The fire-rated wall assembly of claim 1, wherein at least one wallboard comprises a first layer and a second layer that overlaps the first layer.

12. The fire-rated wall assembly of claim 11, wherein the wallboard support includes an abutment portion configured to contact the end surface of the at least one wallboard, wherein the abutment portion is in contact with the first layer, wherein the elongated fire-rated component is in contact with the second layer.

13. The fire-rated wall assembly of claim 1, wherein the at least one wallboard is spaced from an adjacent side surface of the window mullion.

14. The fire-rated wall assembly of claim 1, wherein the wallboard support has a length of at least 4 inches in a direction between the stud and the glass panel.

15. The fire-rated wall assembly of claim 1, wherein the wallboard support has a length of at least 6 inches in a direction between the stud and the glass panel.

16. The fire-rated wall assembly of claim 1, wherein the wallboard support has a length of between 4 and 8 inches in a direction between the stud and the glass panel.

17. The fire-rated wall assembly of claim 1, wherein the wallboard support has a length of between 6 and 8 inches in a direction between the stud and the glass panel.

18. A fire-rated building assembly, comprising:
a first wall;
a second wall oriented at an angle relative to the first wall, the second wall comprising:
a plurality of studs that includes an end stud;
at least one wallboard coupled to the plurality of studs and the end stud and having a cantilevered portion that extends beyond the end stud in a first direction away from a remainder of the plurality of studs;
wherein the at least one wallboard has an end surface facing the first wall, the end surface spaced from the first wall to create a gap therebetween;
a wallboard support coupled to the end stud and extending in the first direction, the wallboard support positioned between the stud and the cantilevered portion of the at least one wallboard;
an elongated fire-rated component coupled to the at least one wallboard, the elongated fire-rated component including a profile having a first leg and a second leg defining an L-shape in cross-section, wherein the first leg is positioned along an outward-facing surface of the wallboard and the second leg is positioned along the end surface of the at least one wallboard, the component further comprises a fire-blocking material strip attached to the profile, wherein at least a portion of the elongated fire-rated component is positioned within the gap;
wherein the wallboard support includes an abutment portion configured to contact the end surface of the at least one wallboard.

19. The fire-rated wall assembly of claim 18, wherein the wallboard support is a metal L-shaped angle piece having a first leg and a second leg, wherein the first leg is coupled to the stud and the second leg defines the abutment portion.

* * * * *